US006796058B2

(12) United States Patent
Pochatko

(10) Patent No.: US 6,796,058 B2
(45) Date of Patent: Sep. 28, 2004

(54) RIGID AND FLEXIBLE SHOE

(75) Inventor: David Pochatko, Williamsville, NY (US)

(73) Assignee: Rigiflex LLC, Clarence, NY (US)

( * ) Notice: Subject to any disclaimer, the term of this patent is extended or adjusted under 35 U.S.C. 154(b) by 0 days.

(21) Appl. No.: 10/328,152

(22) Filed: Dec. 23, 2002

(65) Prior Publication Data

US 2003/0226286 A1 Dec. 11, 2003

Related U.S. Application Data

(60) Provisional application No. 60/387,279, filed on Jun. 7, 2002.

(51) Int. Cl.[7] ..... A43B 13/00

(52) U.S. Cl. ..... 36/102; 36/140; 36/110; 36/25 R

(58) Field of Search ..... 36/102, 140, 110, 36/107, 108, 132, 136, 150, 165, 137, 15

(56) References Cited

U.S. PATENT DOCUMENTS

| | | | | |
|---|---|---|---|---|
| 1,806,409 A | | 5/1931 | Nickerson | |
| 3,517,928 A | * | 6/1970 | Shanahan | 36/132 |
| 3,566,487 A | | 3/1971 | Belghtol | |
| 3,661,151 A | | 5/1972 | Schoenbrun et al. | |
| 3,785,646 A | * | 1/1974 | Ruskin | 36/132 |
| 3,838,696 A | | 10/1974 | Kump | |
| 4,188,735 A | | 2/1980 | Hahn | |
| 4,414,759 A | | 11/1983 | Morgan et al. | |
| 4,430,810 A | * | 2/1984 | Bente | 36/32 R |
| 4,567,678 A | | 2/1986 | Morgan et al. | |
| 4,598,487 A | * | 7/1986 | Misevich | 36/114 |
| 4,624,061 A | * | 11/1986 | Wezel et al. | 36/30 A |
| 4,727,660 A | | 3/1988 | Bernhard | |
| 4,813,162 A | | 3/1989 | Harris | |
| 4,936,028 A | * | 6/1990 | Posacki | 36/15 |
| 5,220,735 A | | 6/1993 | Raoul-Duval | |
| 5,378,223 A | | 1/1995 | Grim et al. | |
| 5,384,970 A | | 1/1995 | Melton | |
| 5,483,757 A | | 1/1996 | Frykberg | |
| 5,970,370 A | | 10/1999 | Besser | |
| 6,050,007 A | * | 4/2000 | Angelieri et al. | 36/137 |
| 6,092,305 A | | 7/2000 | Troy et al. | |
| 6,092,311 A | | 7/2000 | MacNamara | |
| 6,125,557 A | | 10/2000 | Brown | |
| 6,178,664 B1 | | 1/2001 | Yant et al. | |
| 6,269,555 B1 | | 8/2001 | Brown | |
| 6,282,818 B1 | | 9/2001 | Lu | |
| 6,651,360 B1 | * | 11/2003 | Lind | 36/130 |
| 2001/0032397 A1 | | 10/2001 | Ho | |
| 2002/0043005 A1 | | 4/2002 | Blackburn et al. | |

* cited by examiner

*Primary Examiner*—Ted Kavanaugh
(74) *Attorney, Agent, or Firm*—Nixon Peabody LLP

(57) ABSTRACT

The present invention relates to a shoe including an upper section, a flexible sole having first and second opposing surfaces and an opening, wherein at least a portion of a base periphery of the upper section is attached to the flexible sole, and at least one rigid member removably positioned in the opening of the flexible sole. The present invention also relates to a method of making the shoe and a method of treating a foot using the shoe.

34 Claims, 6 Drawing Sheets

RIGID AND FLEXIBLE SHOE

This application claims the benefit of U.S. Provisional Serial No. 60/387,279, filed Jun. 7, 2002, which is hereby incorporated by reference in its entirety.

FIELD OF THE INVENTION

The present application relates to a shoe which can be both rigid and flexible.

BACKGROUND OF THE INVENTION

Many people who have an injury, condition, or surgery to or on their feet will need a shoe that can be rigid and/or flexible during their recovery period. For example, those recovering from surgery to the foot often need a rigid shoe to eliminate movement of the bones and joints of the foot either in the immediate post-operative period or immediately subsequent to removal of a cast. Following that first period, it is frequently necessary and/or desirable to allow some movement of the bones and joints of the foot to encourage recovery. However, as the foot is often still swollen and sore during this second, later period, it is undesirable to allow the patient to wear his or her own shoes. Therefore, it is common for the patient to acquire an oversized pair of sneakers for use during this second, later period of post-operative recovery. However, as the treating physician is not involved in the purchase of the oversized sneakers, there is a risk that the patient will purchase sneakers of an inappropriate size. For example, it is possible that the patient will purchase sneakers which are too tight, thereby interfering with the recovery process.

The present invention is directed to overcoming these and other deficiencies in the art.

SUMMARY OF THE INVENTION

The present invention relates to a shoe including an upper section, a flexible sole having first and second opposing surfaces and an opening, wherein at least a portion of a base periphery of the upper section is attached to the flexible sole, and at least one rigid member removably positioned in the opening of the flexible sole.

The present invention also relates to a method of making a shoe. This method involves providing an upper section and a flexible sole having first and second opposing surfaces and an opening, attaching at least a portion of a base periphery of the upper section to the flexible sole, and removably positioning at least one rigid member in the opening of the flexible sole.

Another aspect of the present invention is a method of treating a foot. This method involves positioning a foot of a user in a shoe including an upper section, a flexible sole having first and second opposing surfaces and an opening, wherein at least a portion of a base periphery of the upper section is attached to the flexible sole, positioning at least one rigid member within the opening of the flexible sole, and subsequently removing the at least one rigid member from the opening of the flexible sole.

The present invention solves the problem of modifying the rigidity of a shoe (e.g., a post-operative shoe) without the need to purchase two separate shoes—one that is rigid and one that is flexible. In addition, the present invention allows a treating physician to properly control the size, shape, and rigidity of a post-operative shoe.

DETAILED DESCRIPTION OF THE INVENTION

Figure 1:
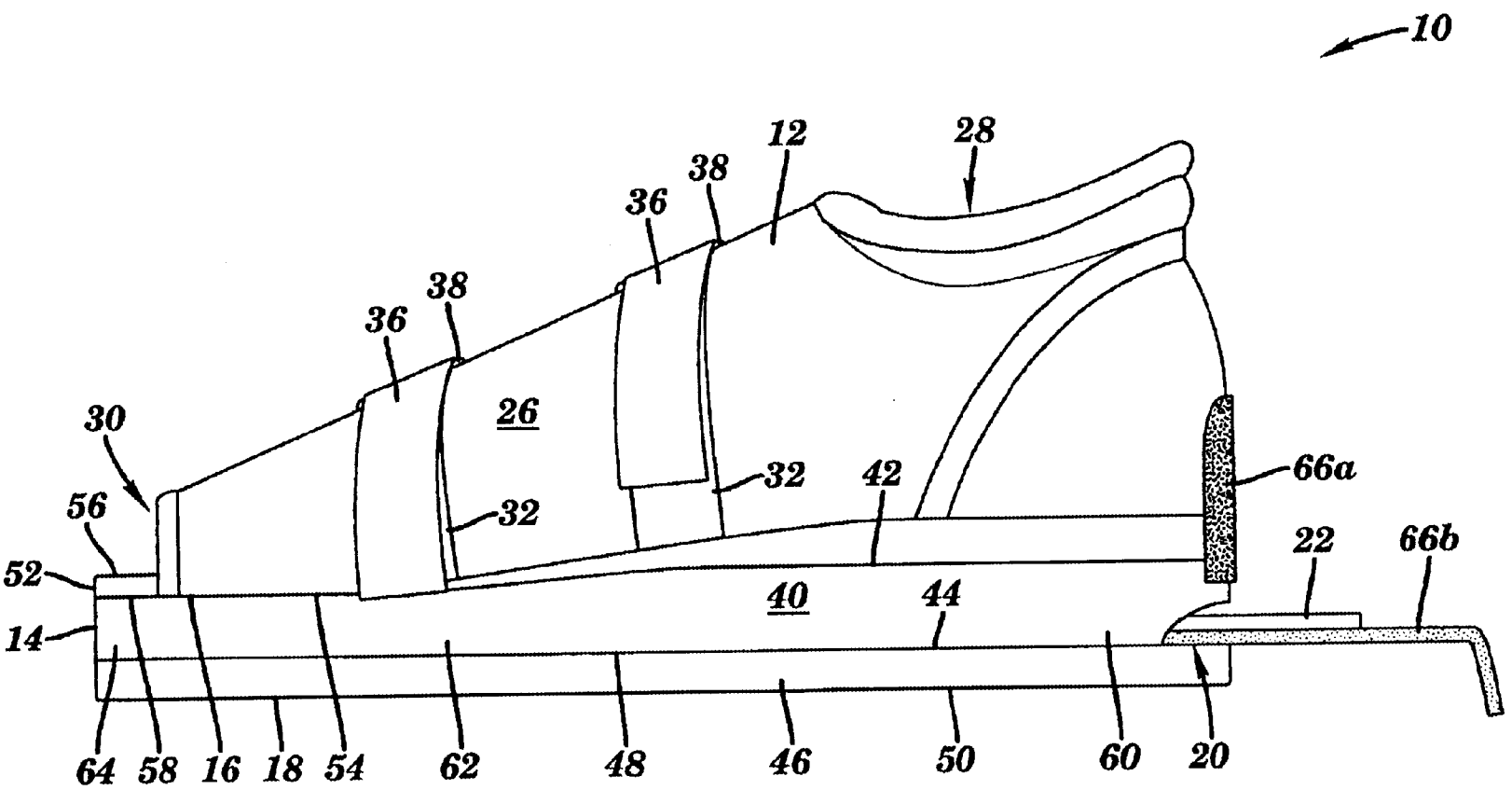
FIG. 1 is a side view of a shoe of the present invention including a rigid member partially removed.

As shown in FIGS. 1-5, the present invention relates to a shoe 10 including an upper section 12, and a flexible sole 14 having first and second opposing surfaces 16, 18 and an opening 20. The shoe 10 also includes a rigid member 22 removably positioned in the opening 20 of the flexible sole 14. As should be evident, the shoe 10 can be designed to be used on either the left or right foot of the user or can be designed for one of the left or right foot of the user. The shoe will come in different sizes for varying foot sizes.

In particular, referring to FIG. 1, shoe 10 includes an upper section 12. The upper section 12 is typically from about 1 mm to about 2 mm in thickness, although other dimensions may be used. The upper section 12 is made of soft upper material. Suitable materials for the upper include, but are not limited to, leather and leather-like materials, vinyl materials, plastics, or cloths, and combinations thereof. Thus, the upper 12 is a soft, flexible material which is comfortable to the foot.

The upper section 12 may also include an inner layer which is less tough and less dense, to conform to the foot of the user. The surfaces of the upper section 16 are substantially smooth, although alternative textures may be used.

Figure 2:
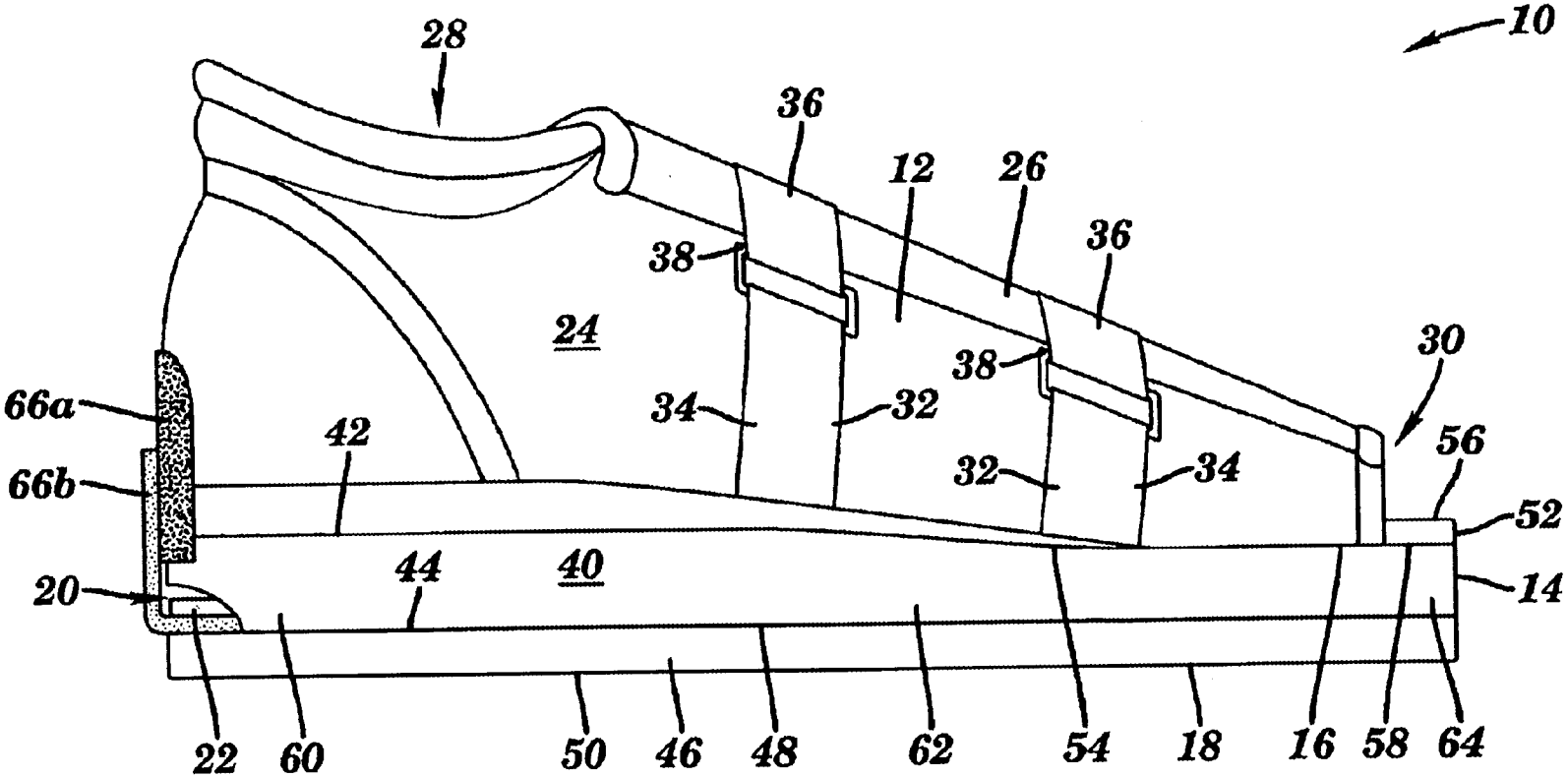
FIG. 2 is a side view of the shoe of FIG. 1 including a rigid member inserted into an opening in the sole of the shoe.
Figure 3A:
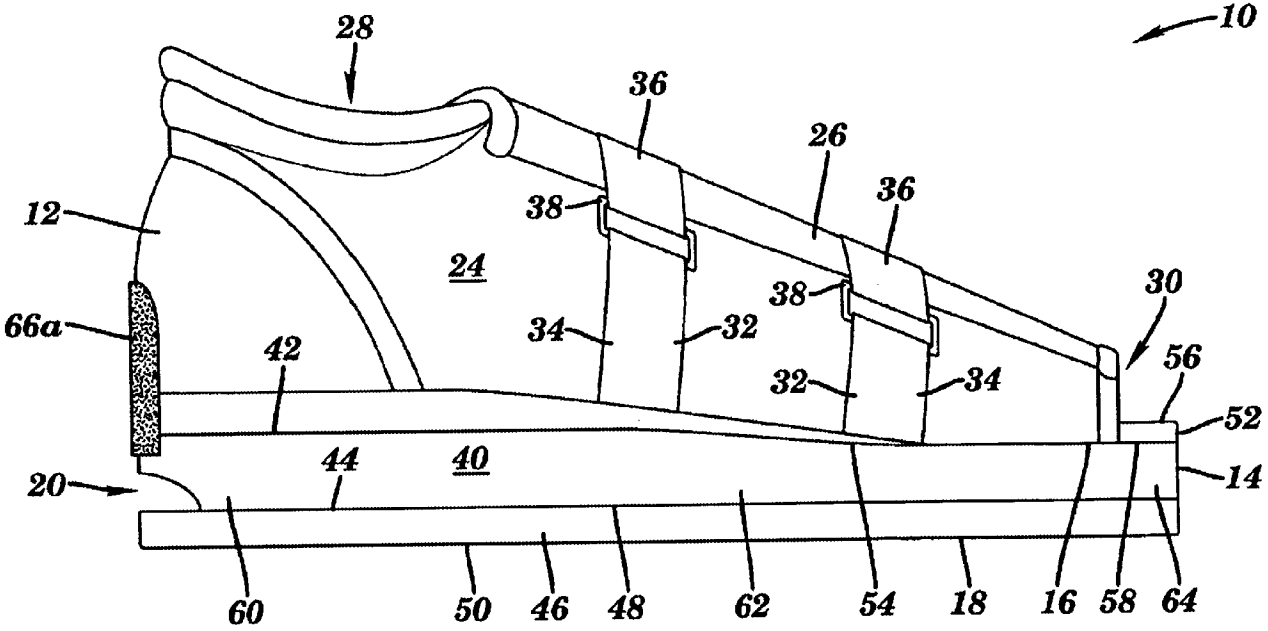
FIG. 3A is a side view of the shoe of FIG. 1 without the rigid member and FIG. 3B is a perspective view of the rigid member of the present invention.
Figure 3B:
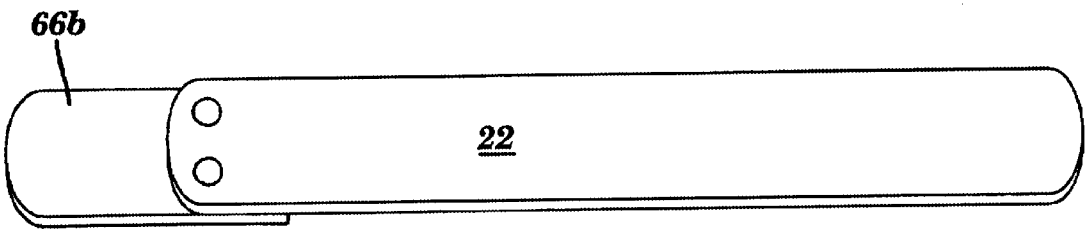
Figure 5:
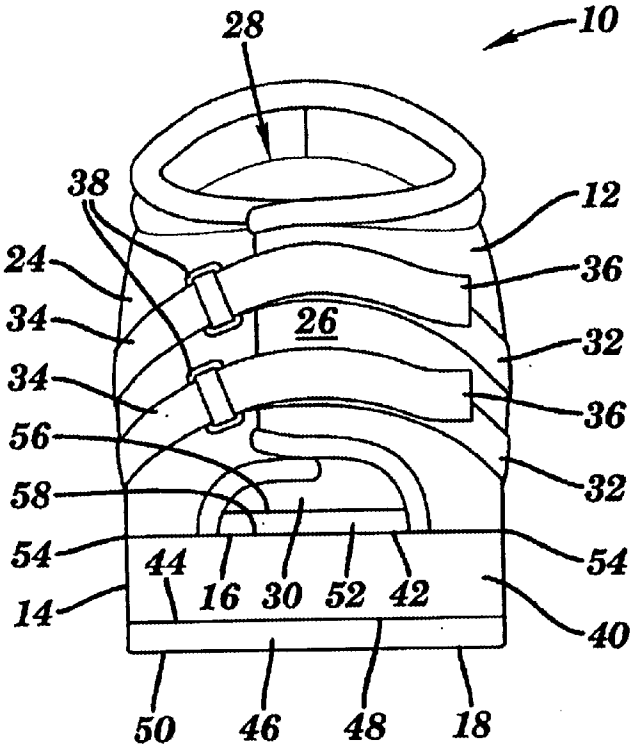
FIG. 5 is a front view of the shoe of FIG. 1.
Figure 4:
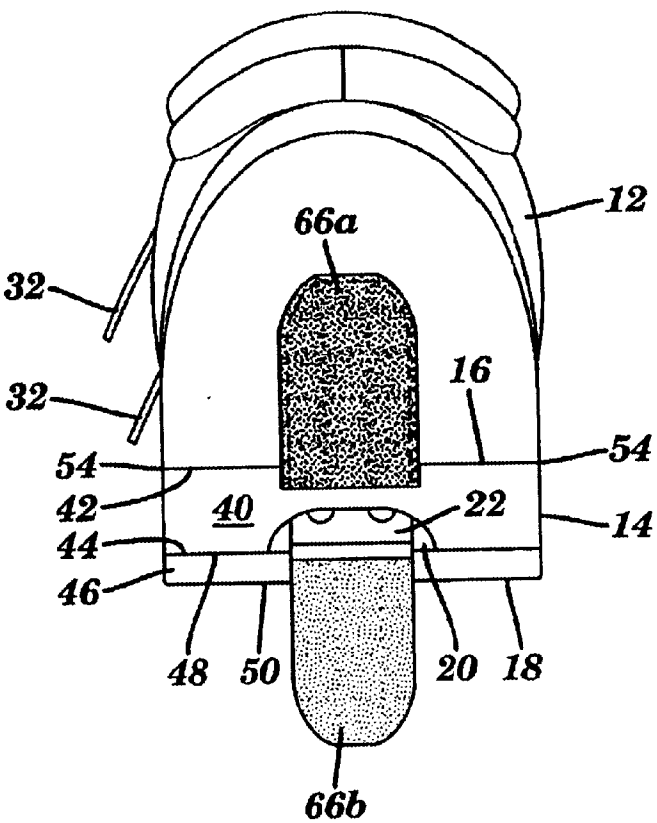
FIG. 4 is an end view of the shoe of FIG. 1.

Referring to FIGS. 2, 3A, and 5, the upper section 12 includes a first side section 24 and a second side section 26, for holding the foot of a user so that the entire foot of the user is encapsulated. Together, the first side section 24 and second side section 26 form the upper for the shoe 10 and have an entry opening 28 for the foot. In this particular embodiment, the first side section 24 and second side section 26 overlap at the tarsal and metatarsal portion of the foot. However, the first side section 24 and second side section 26 may overlap at any portion of the foot. In another embodiment, the first side section 24 and second side section 26 may not overlap. The upper section 12 of this embodiment further includes an open toe portion 30. The use of an open toe portion 30 allows the shoe to be more easily placed on the user. Although one type of upper section 12 is shown, other variations of the upper section 12 can be used, such as a one-piece upper section.

As shown in FIGS. 1–5, in this embodiment, the upper section 12 includes a plurality of fasteners 32. The fasteners 32 on the upper section 12 may be made of similar material to the upper section 12 and secure the shoe 10 to a foot. In this particular embodiment, two fasteners 32 are shown, however, any number of fasteners may be used. Also, in this particular embodiment, the fasteners comprise hook and loop type fasteners (e.g., Velcro™) including a first portion 34 attached to first side section 24 and a second portion 36 attached to the second side section 26. The first portion includes a loop 38. A first section of the second portion 36 may be feed through loop 38 on the first portion 34 of the fastener and secured to a second section of the second portion 36 using the hook and loop type fasteners to secure the upper section 12 around a foot. Although one type of fastener is shown, other suitable fasteners may be used, including, but not limited to, buckles, snaps, laces, clips, and any other device for securing the upper section 12 to a foot. Although a plurality of fasteners 32 are shown in this embodiment, the shoe 10 may be provided with a single fastener 32.

In this particular embodiment, the flexible sole 14 is generally in the shape of a foot, although other shapes may be used. This shape allows the foot of a user to be comfortably placed within the shoe 10. The flexible sole 14 is substantially planar and is typically about 1–2 cm in thickness, although other dimensions may be used and a non-planar sole may be used (e.g., with arch support). As shown in FIGS. 1–3 and 5, as used herein, the flexible sole 14 is an outsole (i.e., a supportive structure which makes contact with the ground). The sole 14 includes an inner layer 40 having first 42 and second 44 opposing substantially planar surfaces and an outer layer 46, having first 48 and second 50 opposing substantially planar surfaces. The inner layer 40 is typically about 0.5 to 1.5 cm in thickness and the outer layer 46 is typically about 0.5 cm in thickness, although other dimensions may be used. The second surface 44 of the inner layer 40 is adjacent and in contact with the first surface 48 of the outer layer 46. In particular, the second surface 44 of the inner layer 40 is adhered to the first surface 48 of the outer layer 46. The inner layer may be adhered to the outer layer using suitable techniques known in the art.

Also, as shown in FIGS. 1–3 and 5, in this particular embodiment, the shoe 10 includes an insole 52.

Referring to FIG. 1, at least a portion of a base periphery 54 of the upper section 12 is attached to the flexible sole 14. In this particular embodiment, the entire base periphery 54 of the upper section 12 is attached between the sole 14 and insole 52. Suitable techniques for attachment include, but are not limited to, adhesives, staples, stitching, and the like, or any combination of these techniques. Although one example is shown, at least a portion of the base periphery 54 of the upper section 12 may be attached to the sole 14 in any desired fashion. For example, at least a portion of the base periphery 54 of the upper section 12 may be attached to the outside wall of the inner layer 40 of the sole 14.

Also, in this particular embodiment the sole 14 is made of a flexible material. Use of a flexible material allows the shoe to at least partially bend, thereby allowing the bones and joints of the foot to move. The sole 14 of the shoe is made of a durable type material that wears well and will not collapse yet it will be flexible. Suitable materials for the sole 14 include, but are not limited to, rubber or rubber-like materials, vinyl materials, injection molded materials, wood or wood-like materials, ethyl vinyl acetate (EVA), and polyurethanes. In this particular embodiment, the sole 14 is made of a relatively durable material and includes a suitable tread surface.

Referring to FIGS. 1–3 and 5, in this particular embodiment, the insole 52 is of appropriate dimensions to be placed on top of the sole 14 and within the upper section 12. The insole 52 is provided for comfort and does not form part of the primary supportive structure of the shoe 10. The insole 52 is generally in the shape of a foot, although other shapes may be used. Further, the insole 52 is substantially planar and includes substantially planar first 56 and second 58 surfaces, although a non-planar insole may be used. Also, the insole 52 is typically from about 3 mm to about 6 mm in thickness, although other dimensions may be used. For the purposes of comfort and conformity to the foot of the user, the insole comprises a relatively soft and flexible pad, such as a foam pad, that is bonded to the first surface 42 of the inner layer 40 of the sole 14. Suitable materials for the insole 52 include, but are not limited to, any type of foam or sponge, and any closed cell material with or without memory and with any suitable density (e.g., PPT, Poron™, Plastazote™, Aliplast™, and Puff™).

As shown in FIGS. 1–4, the sole 14 includes an opening 20. In this particular embodiment, the opening 20 is a channel within the inner layer 40 of the sole 14 that extends longitudinally from a heel portion 60 of the shoe to the position where the ball of the foot is located 62 (ball position). In this particular embodiment, the opening 20 is positioned within the inner layer 40 of the sole adjacent the outer layer 46 of the sole. However, the opening may be positioned at any location in the inner layer 40 between its first 42 and second 44 surfaces. Alternatively, the opening 20 may be positioned in the outer layer 46 of the sole 14. The opening 20 may be any suitable shape and size for insertion of a rigid member 22, as described below. For example, the opening 20 may be a channel within the inner layer 40 of the sole 44 that extends longitudinally from the heel portion 64 of the shoe to the toe portion 64 of the shoe.

The opening 20 in the sole of the shoe 10 allows the placement of a removable rigid member or shank 22, such that, when this rigid member 22 is in at least one first position in the opening within the sole 14 (see FIGS. 1–2 and 4), it will cause the sole to become rigid, thereby decreasing and/or eliminating movement of the joints/bones of the feet. When the rigid member 22 is in a second position completely external to the opening 20 of the sole 14 (see FIGS. 3A–B), the sole remains flexible, thereby allowing movement of the joints/bones of the feet. In this embodiment, as shown in FIGS. 1–4, the rigid member 22 is removably held in the opening 20 by a hook and loop type fastener **66*a* and 66*b*. However, the rigid member 22 may be removably held in the opening through a friction fit or any other suitable fastening arrangement, as described above. The opening 20 and rigid member 22 are positioned in the shoe 10** to immobilize the foot, for example, extending from the heel position to the position where the ball of the foot is located (i.e., ball position) or from the heel position to the toe position.

The rigid member 22 is made of any suitable rigid material. For example, suitable materials for the rigid member 22 include, but are not limited to, carbon fiber or carbon fiber-type materials, steel, fiberglass, plastics, and combinations thereof. Thus, the rigid member 22 is made of any rigid material that can be inserted into the sole 14 and removed in the future. Accordingly, through insertion and removal of the rigid member, the sole of the shoe 10 can be both rigid and flexible. The rigid member may have a thickness of from about 2 to 4 mm, although any desired thickness may be used. In addition, the rigid member may have a rigidity measured as flexural strength using the ASTM D790 testing method of from about 9,000 psi to about 40,000 psi, although any desired rigidity may be used depending upon the desired rigidity of the shoe and the number of rigid members used.

Although the shoe of the present invention as described above includes a single rigid member 22 in a single opening 20, multiple rigid members and multiple openings may be used. In addition, a single opening 20 may be provided with multiple rigid members 22 of varying rigidities. Thus, the rigidity of the shoe 10 can be varied depending upon which rigid member is inserted within the opening 20.

Figure 6:
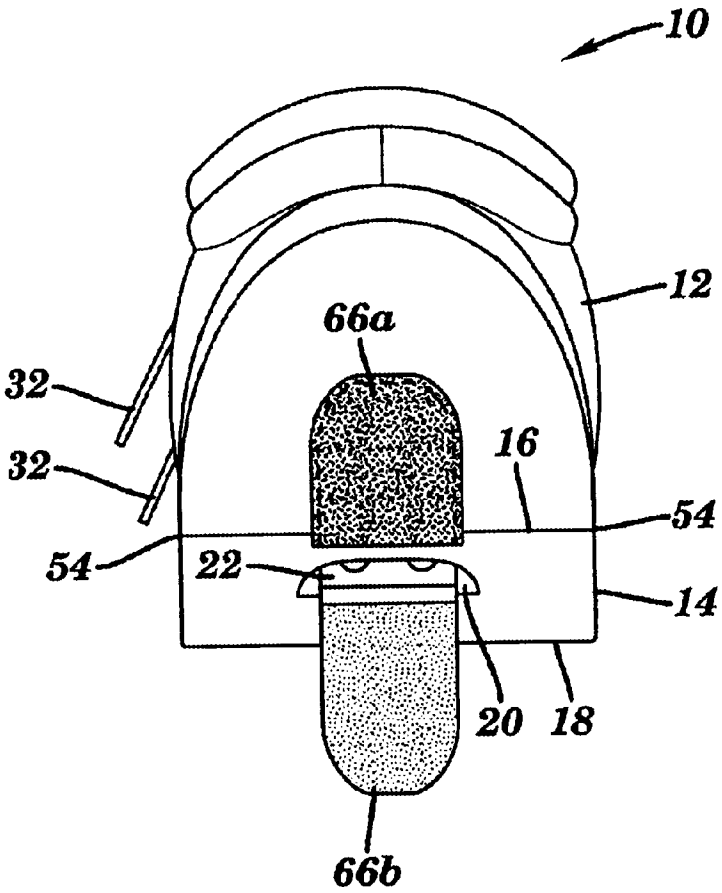
FIG. 6 is an end view of a second embodiment of a shoe of the present invention.

A shoe 10 in accordance with a second embodiment of the present invention is shown in FIG. 6. In this embodiment, the shoe 10 is identical to the above-described shoe, except as described below.

Referring to FIG. 6, shoe 10 includes a rigid member 22 positioned in opening 20. The opening 20 is substantially centrally located between the first 16 and second 18 surfaces of sole 14. Moreover, sole 14 includes a single layer.

Figure 7:
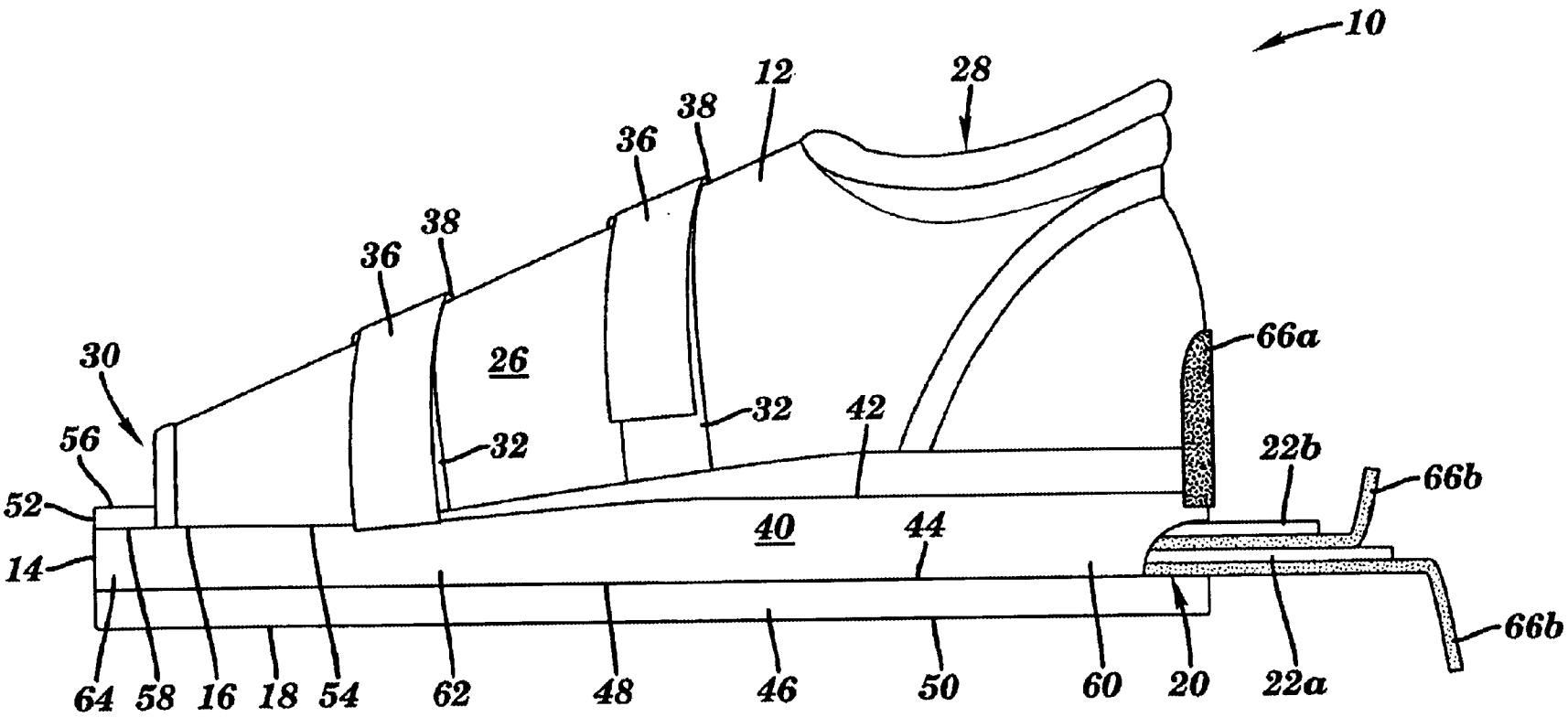
FIG. 7 is a side view of a third embodiment of a shoe of the present invention.

A shoe 10 in accordance with a third embodiment of the present invention is shown in FIG. 7. In this embodiment, the shoe 10 is identical to the above-described shoe, except as described below.

Referring to FIG. 7, shoe 10 includes two rigid members 22*a* and 22*b* positioned in opening 20. The rigid members 22*a* and 22*b* may be removed sequentially to vary the rigidity of the shoe from rigid (two rigid members positioned in opening 20), to semi-rigid (one rigid member positioned in opening 20), to flexible (no rigid members in opening 20). Alternatively, the rigid members 22*a* and 22*b* may be inserted/removed together.

The shoe 10 of the present invention may be provided in different sizes for users with different sized feet. It is contemplated that one or more shoes 10 of smaller dimensions could be used for children while one or more shoes 10 of larger dimensions could be used for adults.

The shoe 10 described herein is a health shoe (i.e., a shoe used in treatment of a medical condition of the foot). In particular, the shoe 10 is a post-operative shoe. However, the shoe 10 may be any type of shoe for which modification of rigidity is desired.

Another aspect of the present invention is a method of treating a foot. This method involves positioning a foot of a user in a shoe including an upper section, a flexible sole having first and second opposing surfaces and an opening, wherein at least a portion of a base periphery of the upper section is attached to the flexible sole, positioning at least one rigid member within the opening of the flexible sole, and subsequently removing the at least one rigid member from the opening of the flexible sole.

The method of treating a foot in accordance with the present invention is applicable to numerous types of treatment. For example, the above method may be used to treat a foot fracture (e.g., a fracture of the forefoot—metatarsals and/or toes). Typically, for treatment of a foot fracture the at least one rigid member is removed after approximately 1–2 months. The above method may also be used to treat an injury to the foot which does not involve a fracture. Such injuries include inflammation of the metatarsal/phalangeal joints, where the rigid member is inserted into the sole of the shoe of the present invention to rest the inflamed joints and may be removed after approximately 1–2 months, swollen feet (e.g., after cast removal), and sprains to the feet, where the rigid member may be removed after approximately one month. In addition, the above method may be used to treat a post-surgical foot. For example, after surgery for arthritis, bunion removal, or a hammer toe, it is preferable to keep the foot immobile immediately after surgery to prevent damage to the surgical repair. However, after about one week to about one month post-surgery, depending upon the type of surgery and progression of the patient, it is desirable to allow some movement of the foot (e.g., after pin removal in hammer toe surgery). Moreover, use of the shoe of the present invention in the above-described method of the present invention to treat a foot post-surgery for a hammer toe prevents squeezing pressure on the treated toe, leading to a faster recovery.

The use of the shoe 10 will now be discussed in detail. In use, the user or user's physician/medical advisor selects a shoe 10 of appropriate size. Typically, the upper section 12 and sole 14 will be pre-assembled into the shoe 10. The user takes hold of the upper section 12. If fasteners 32 are present, the user loosens or temporarily removes the fasteners 32. Subsequently, the user pulls apart the first side 24 and the second side 26 of the upper section 12 to enlarge the entry opening 28 for the foot. Then, the user inserts his or her foot into the upper section 12 of the shoe. When the user's foot is present in the upper section 12, the user's weight causes the soft and flexible pad of the insole 52 and the inner layer of the upper section 12, if present, to conform to the contours of the user's foot. If fasteners 32 are present, they are fastened to secure the upper section 12 around the foot of the user. The user or user's physician/medical advisor then inserts at least one rigid member 22 of desired rigidity into the opening 20 in the sole 14 of the shoe, thereby reducing/eliminating movement of the bones and joints of the foot. Alternatively, the at least one rigid member 22 may be inserted prior to placement of the shoe 10 on the foot. At a later date, the at least one rigid member 22 may be substituted with a second or further additional rigid members 22 of different rigidities, to allow a controlled amount of movement of the bones and joints of the foot. Finally, the at least one rigid member 22 may be removed from the sole 14 of the shoe 10, thereby allowing movement of the bones and joints of the foot to the degree of flexibility of the flexible sole 14. If desired, the same procedure is followed for the other foot of the user.

Although the invention has been described in detail for the purpose of illustration, it is understood that such detail is solely for that purpose, and variations can be made therein by those skilled in the art without departing from the spirit and scope of the invention which is defined by the following claims.

What is claimed:

1. A shoe comprising:

an upper section;

a flexible sole having first and second opposing surfaces, a channel formed within the flexible sole extending longitudinally from a heel portion thereof, and an opening to the channel at the heel portion, wherein at least a portion of a base periphery of the upper section is attached to the flexible sole; and at least one rigid member removably positioned in the channel of the flexible sole.

2. The shoe according to claim 1, wherein the at least one rigid member is made of a material selected from the group consisting of carbon fiber, steel, fiberglass, and plastics.

3. The shoe according to claim 1, wherein the at least one rigid member is fastened to the flexible sole using a fastening device selected from the group consisting of hook and loop fastners, buckles, snaps, laces, clips, and friction fit.

4. The shoe according to claim 1, wherein the flexible sole is generally in the shape of a foot.

5. The shoe according to claim 1, wherein the upper section is made of a material selected from the group consisting of leather, vinyls, plastics, and cloths.

6. The shoe according to claim 1, wherein the upper section comprises one or more fasteners.

7. The shoe according to claim 1 further comprising:

an insole having first and second opposing surfaces, wherein the second surface of the insole is adjacent and in contact with the first surface of the flexible sole.

8. The shoe according to claim 7, wherein the insole is made of a material selected from the group consisting of open-cell foam, closed-cell foam, and sponges.

9. The shoe according to claim 7, wherein the insole is generally in the shape of a foot.

10. The shoe according to claim 1, wherein the flexible sole is made of a material selected from the group consisting of rubber, vinyls, injection-molded materials, wood, ethyl vinyl acetate, and polyurethanes.

11. The shoe according to claim 1, wherein the channel extends longitudinally from the heel portion of the flexible sole to at least a ball portion of the flexible sole.

12. The shoe according to claim 1, wherein the channel extends longitudinally from the heel portion of the flexible sole to a toe portion of the flexible sole.

13. The shoe according to claim 1, wherein the shoe is a post-operative shoe.

14. The shoe according to claim 1, wherein two or more rigid members are removably positioned in the opening of the flexible sole.

15. A method of treating a foot comprising:

positioning a foot of a user in the shoe according to claim 1;

positioning at least one rigid member within the channel of the flexible sole; and subsequently removing the at least one rigid member from the channel of the flexible sole.

16. The method according to claim 15 wherein said positioning at least one rigid member is carried out with two rigid members.

17. The method according to claim 16 wherein said subsequently removing the at least one rigid member comprises:

first removing one of the two rigid members and second removing the other of the two rigid members.

18. The method according to claim 17 wherein said first removing is carried out after a delay following a surgical procedure.

19. The method according to claim 18 wherein said second removing is carried out after a delay following said first removing.

20. A method of making a shoe comprising:

providing an upper section and a flexible sole having first and second opposing surfaces, a channel formed within the flexible sole extending longitudinally from a heel portion thereof, and an opening to the channel at the heel portion;

attaching at least portion of a base periphery of the upper section to the flexible sole; and removably positioning at least one rigid member in the channel of the flexible sole.

21. The method according to claim 20, wherein the at least one rigid member is made of a material selected from the group consisting of carbon fiber, steel, fiberglass, and plastics.

22. The method according to claim 20 further comprising:

fastening the at one least rigid member to the flexible sole using a fastening device.

23. The method according to claim 22, wherein the fastening device is selected from the group consisting of hook and loop fasteners, buckles, snaps, laces, clips, and friction fit.

24. The method according to claim 20, wherein the flexible sole is generally in the shape of a foot.

25. The method according to claim 20, wherein the upper section is made of a material selected from the group consisting of leather, vinyls, plastics, and cloths.

26. The method according to claim 20, wherein the upper section comprises one or more fasteners.

27. The method according to claim 20 further comprising:

providing an insole having first and second opposing surfaces, and positioning the second surface of the insole adjacent and in contact with the first surface of the flexible sole.

28. The method according to claim 27, wherein the insole is made of a material selected from the group consisting of open-cell foam, closed-cell foam, and sponges.

29. The method according to claim 27, wherein the insole is generally in the shape of a foot.

30. The method according to claim 20, wherein the flexible sole is made of a material selected from the group consisting of rubber, vinyls, injection-molded materials, wood, ethyl vinyl acetate, and polyurethanes.

31. The method according to claim 20, wherein the channel extends longitudinally from the heel portion of the flexible sole to at least a ball portion of the flexible sole.

32. The method according to claim 20, wherein the channel extends longitudinally from the heel portion of the flexible sole to a toe portion of the flexible sole.

33. The method according to claim 20, wherein the shoe is a post-operative shoe.

34. The method according to claim 20, wherein at least two rigid members are removably positioned in the opening of the flexible sole.

* * * * *